US005440103A

United States Patent [19]

Martin

[11] Patent Number: 5,440,103

[45] Date of Patent: Aug. 8, 1995

[54] COOKING APPARATUS, LATCHING CONSTRUCTION THEREFOR AND METHODS OF MAKING THE SAME

[75] Inventor: David D. Martin, Dunbar, Pa.

[73] Assignee: Robertshaw Controls Company, Richmond, Va.

[21] Appl. No.: 250,006

[22] Filed: May 27, 1994

[51] Int. Cl.[6] ..... F24C 7/08; H05B 1/02

[52] U.S. Cl. ..... 219/413; 219/724; 126/197; 292/DIG. 69; 200/50 A

[58] Field of Search ..... 219/722, 723, 724, 412, 219/413, 414; 200/50 A, 50 R, 61.62, 61.76, 61.78, 61.81; 292/DIG. 69, 261; 126/192, 197

[56] References Cited

U.S. PATENT DOCUMENTS

| | | | |
|---|---|---|---|
| 3,784,776 | 1/1974 | Asanuma | 219/724 |
| 3,805,528 | 4/1974 | Huebscher | 60/530 |
| 4,095,427 | 6/1978 | Stropkay | 60/530 |
| 4,887,429 | 12/1989 | Birli, Sr. et al. | 60/527 |
| 4,901,474 | 2/1990 | Bayard et al. | 49/26 |
| 4,927,996 | 5/1990 | Genbauffe et al. | 219/413 |
| 4,935,989 | 6/1990 | Miller | 16/66 |
| 4,951,693 | 8/1990 | Archambault | 292/DIG. 69 |
| 5,375,437 | 12/1994 | Dausch et al. | 292/DIG. 69 |

OTHER PUBLICATIONS

Copending patent application, Ser. No. 229,378, filed Apr. 18, 1994.

*Primary Examiner*—Philip H. Leung
*Attorney, Agent, or Firm*—Candor, Candor & Tassone

[57] ABSTRACT

A cooking apparatus, a latching construction therefor and methods of making the same are provided, the latching construction comprising a frame carrying a movable latch member and a drive unit operatively interconnected to the latch member to move the latch member between the latching and unlatching positions thereof, the drive unit comprising a cylinder having opposite ends and a movable piston extending from one of the opposite ends and being operatively interconnected to the latch member, the drive unit having an actuator to extend the piston so as to be adapted to move the latch member from its non-latching position thereof to its latching position thereof when the actuator is first actuated for a door locking operation thereof, the drive unit having an additional unit adapted to cause the piston to be retracted after the latch member has been moved to the latching position thereof by the first activation of the actuating unit while maintaining the latch member in its latching position until the actuating means is again actuated.

20 Claims, 4 Drawing Sheets

COOKING APPARATUS, LATCHING CONSTRUCTION THEREFOR AND METHODS OF MAKING THE SAME

BACKGROUND OF THE INVENTION

1. Field of the Invention

This invention relates to a new cooking apparatus and to a new door latching construction for such a cooking apparatus as well as to a new method of making such a cooking apparatus and to a new method of making such a door latching construction.

2. Prior Art Statement

It is known to provide a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in a closed position and actuates the switch means if the door means is in a closed position at the time the latch member is moved to the latching position thereof, and drive means carried by the frame means and having moving means operatively interconnected to the latch member to move the latch member between the positions thereof only when the moving means of the drive means moves from a first position thereof to a second position thereof, the drive means comprising a cylinder means having opposite ends and a movable piston means extending from one of the opposite ends and comprising the moving means operatively interconnected to the latch member, the drive means having actuating means to extend the piston means so as to be adapted to move the latch member from its non-latching position thereof to its latching position thereof when the actuating means is actuated for a door locking operation thereof. For example, see the copending patent application of Thomas M. Martin, David D. Martin, and Eric V. Russ, Ser. No. 229,378, filed Apr. 18, 1994.

It is also known to provide an electro-thermal drive means wherein the same comprises a cylinder means having opposite ends and a movable piston means extending from one of the opposite ends thereof, the drive means having a compression spring means tending to retract the piston means from its extended condition whenever the actuating means of the drive means is actuated to extend the piston means to an extended position thereof and is then deactuated. For example, see the U.S. patent to Huebscher, U.S. Pat. No. 3,805,528; the U.S. patent to Stropkay, U.S. Pat. No. 4,095,427 and the U.S. patent to Birli, Sr. et al, U.S. Pat. No. 4,887,429.

Also see the U.S. patent to Genbauffe et al, U.S. Pat. No. 4,927,996 for a latching construction of a cooking apparatus wherein the latch member is moved by a drive means that comprises an electrical motor.

SUMMARY OF THE INVENTION

It is one of the features of this invention to provide a new drive means for uniquely operating the movable latch member of a door latching construction of a cooking apparatus or the like.

In particular, while it was found according to the teachings of the invention set forth in the aforementioned copending U.S. patent application, Ser. No. 229,378, filed Apr. 18, 1994, that a piston and cylinder type of drive means can be uniquely arranged to operate the movable latch member of the latching construction so as to provide a relatively inexpensive drive means in contrast to the expensive electrical motor means previously utilized, the actuating means of such a piston and cylinder type of drive means is required to be continuously actuated to hold the latch member in its door locking position or some structure is required to maintain the piston means of the drive means in its extended condition in order to maintain the latch member in its door locking position until it was desired to unlock the oven door.

However, it was found according to the teachings of this invention that such a drive means can be provided with a unique additional means that is adapted to permit the piston means of the drive means to be retracted after the latch member has been moved to the latching position thereof by an initial activation of the actuating means while maintaining the latch member in its latching position until the actuating means of the drive means is again actuated. Thus, it can be seen that the actuating means of the drive means of this invention need not be in a continuously actuated condition thereof in order to maintain the latch member in its locking position nor does the piston means of such drive means need to be maintained in its extended condition during the entire time that the door latching member is in its door latching position.

For example, one embodiment of this invention comprises a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in its closed position and actuates the switch means if the door means is in its closed position at the time the latch member is moved to the latching position thereof, and drive means carried by the frame means and having moving means operatively interconnected to the latch member to move the latch member between the positions thereof only when the moving means of the drive means moves from a first position thereof to a second position thereof, said drive means comprising a cylinder means having opposite ends and a movable piston means extending from one of the opposite ends and comprising the moving means operatively interconnected to the latch member, the drive means having actuating means to extend the piston means to be adapted to move the latch member from its non-latching position thereof to its latching position thereof when the actuating means is first actuated for a door locking operation thereof, the drive means having additional means adapted to cause the piston means to be retracted after the latch member has been moved to the latching position thereof by the first activation of the actuating means while maintaining the latch member in its latching position until the actuating means is again actuated.

Accordingly, it is an object of this invention to provide a new cooking apparatus having one or more of the novel features of this invention as set forth above or hereinafter shown or described.

Another object of this invention is to provide a new method of making such a cooking apparatus, the method of this invention having one or more of the novel features of this invention as set forth above or hereinafter shown or described.

Another object of this invention is to provide a new latching construction for a cooking apparatus, the latching construction of this invention having one or more of the novel features of this invention as set forth above or hereinafter shown or described.

Another object of this invention is to provide a new method of making such a latching construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
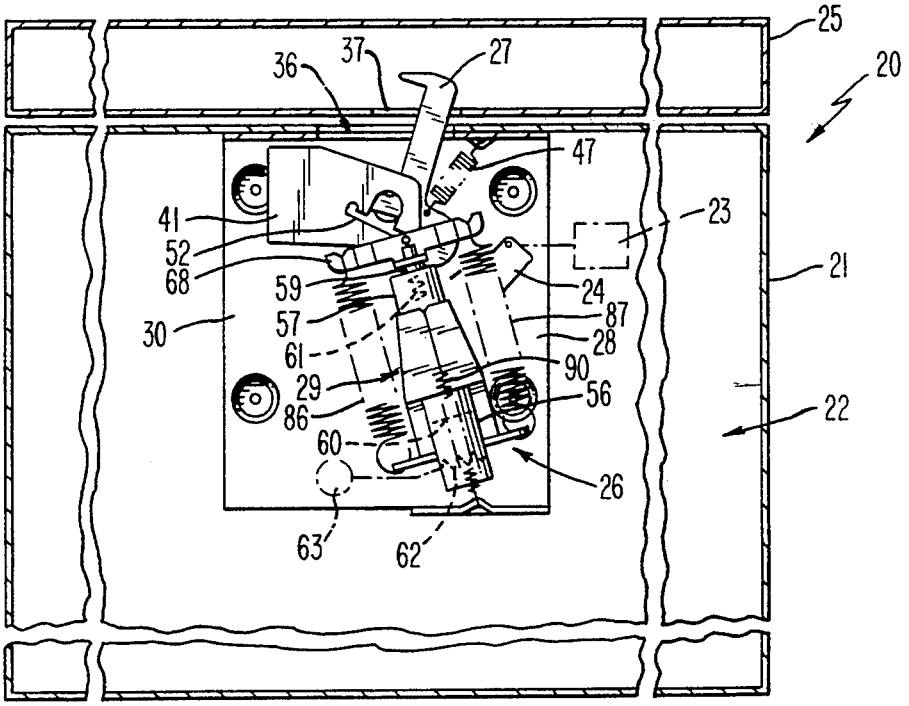
FIG. 1 is a schematic cross-sectional view illustrating the new cooking apparatus of this invention utilizing the new door latching construction of this invention, the door means of the cooking apparatus being in its closed position and the latch member of the latching construction being in its non-latching position.

While the various features of this invention are hereinafter illustrated and described as being particularly adapted to provide a door latching construction for a particular cooking apparatus, it is to be understood that the various features of this invention can be utilized singly or in various combinations thereof to provide a door latching construction for other types of cooking apparatus as desired.

Therefore, this invention is not to be limited to only the embodiment illustrated in the drawings, because the drawings are merely utilized to illustrate one of the wide variety of uses of this invention.

Referring now to FIG. 1, a new cooking apparatus of this invention is generally indicated by the reference numeral 20 and comprises a frame means 21 carrying a cooking chamber means 22 and a heating means 23 that is adapted to be actuated to heat clean the chamber means 22 in a manner well known in the art. An electrical switch means 24 is carried by the frame means 21 in a manner hereinafter set forth and permits the heating means 23 to heat clean the chamber means 22 only when the switch means 24 is actuated to a certain condition thereof.

Figure 11:
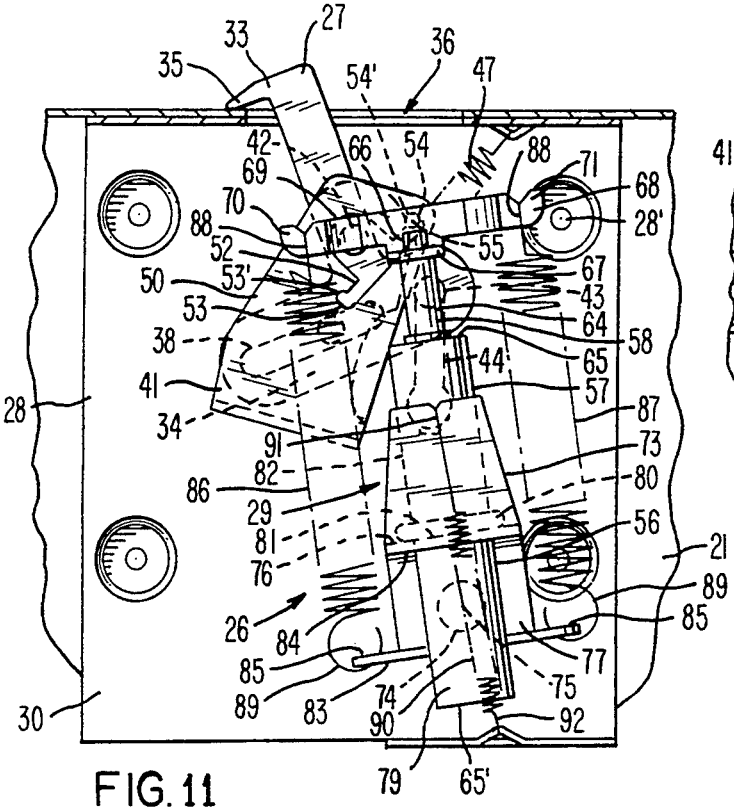
FIG. 11 is a view similar to FIG. 2 and illustrates the latching member having been moved to a third position thereof when the oven door means is in an open position and the drive means for the latch member tends to move the latch member from its non-latching position to its latching position.
Figure 12:
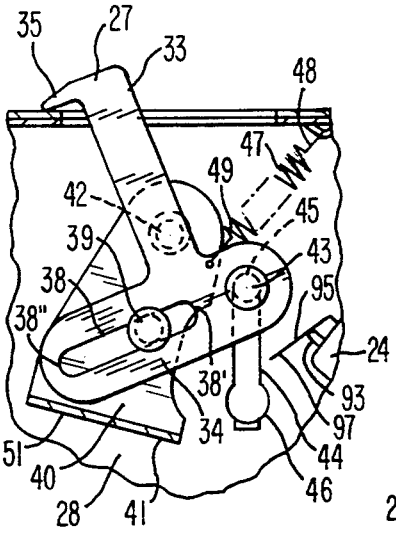
FIG. 12 is a view similar to FIG. 4 and illustrates the latch member having been moved to its third position as illustrated in FIG. 11.

The cooking apparatus 20 has a movable door means 25 that is movably carried by the frame means 21 in a conventional manner for opening and closing the cooking chamber means 22, the door means 25 being shown in the closed condition in FIGS. 1, 2, 3, 5, 6, 7, 8, 9 and 10 and in its open condition in FIGS. 11 and 12.

Figure 2:
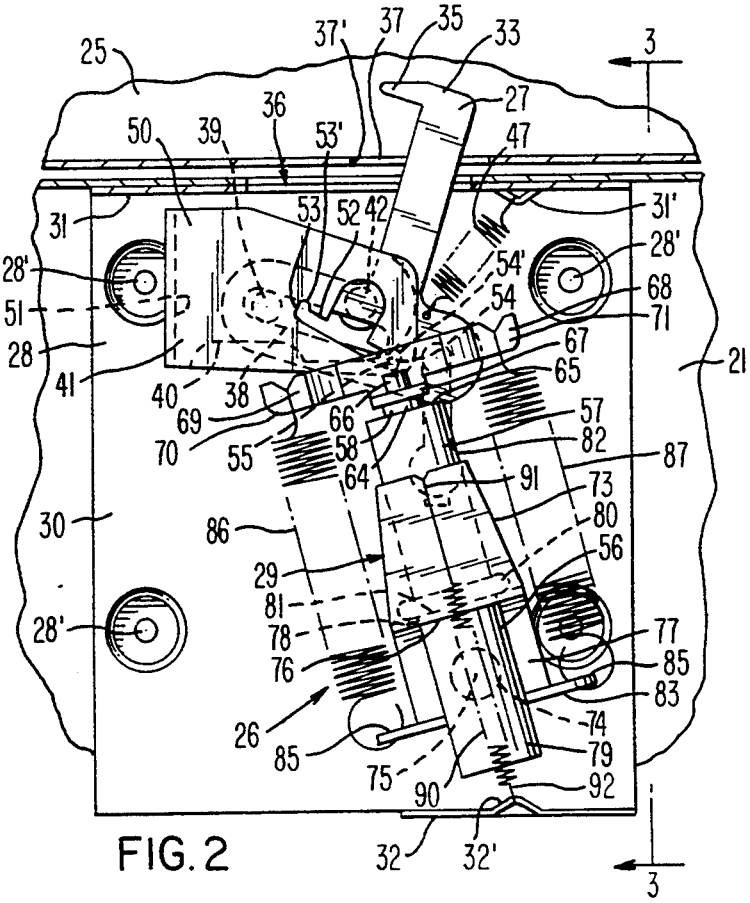
FIG. 2 is an enlarged fragmentary view of the latching structure of FIG. 1.
Figure 3:
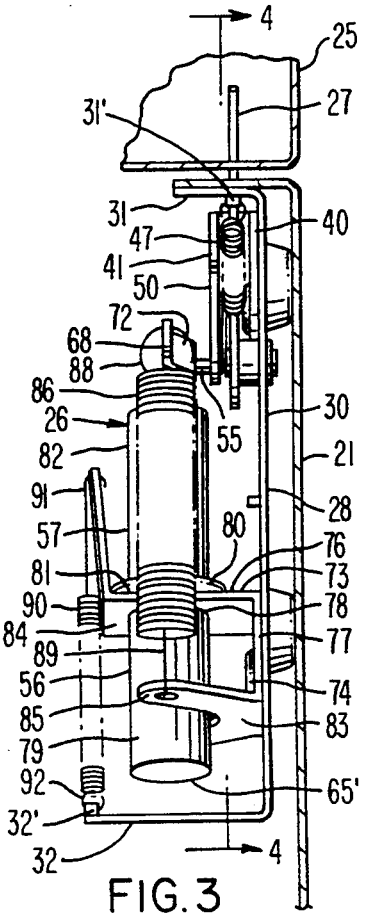
FIG. 3 is a fragmentary cross-sectional view taken on line 3—3 of FIG. 2.

A new door latching construction of this invention is generally indicated by the reference numeral 26 and is carried by the frame means 21 of the cooking apparatus 20 in a manner hereinafter set forth, the latching construction 26 comprising a movable latch member 27 carried by a frame means 28 that forms part of the main frame means 21 and can be spot welded thereto in the manner illustrated by the reference numerals 28' in FIG. 2 to position the frame means 28 as illustrated in FIG. 3.

Figure 7:
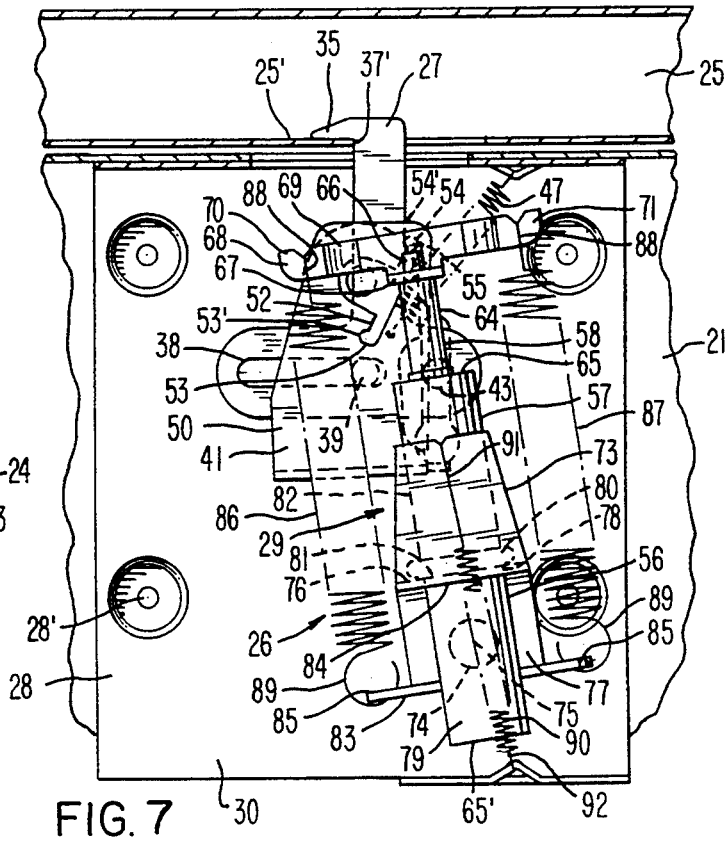
FIG. 7 is a view similar to FIG. 5 and illustrates the latching member having been moved to its door latching position by the drive means of the latching construction of FIG. 1.
Figure 9:
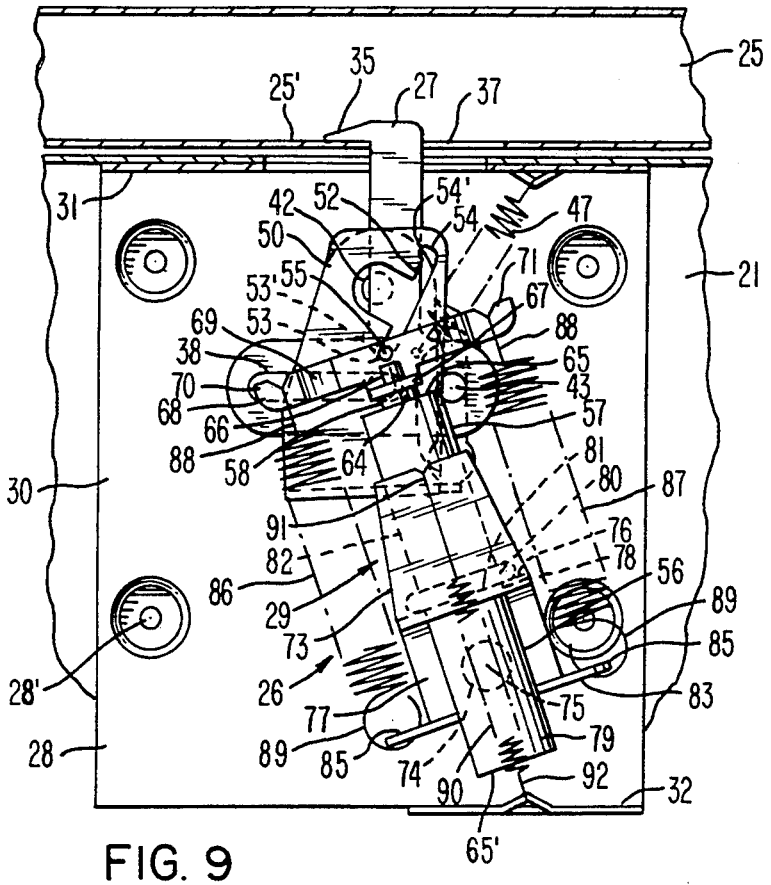
FIG. 9 is a view similar to FIG. 7 and illustrates the drive means after the piston means thereof has been fully retracted and while maintaining the latch member in its door locking position.

The latch member 27 is operatively interconnected to a drive means of this invention that is generally indicated by the reference numeral 29 in the drawings, the latch member 27 being movable between a non-latching position thereof as illustrated in FIG. 2 that permits the door means 25 to be opened and closed as desired and a latching position thereof as illustrated in FIGS. 7 and 9 that locks the door means 25 in its closed condition if, at the time the latch member is moved to the latching position thereof by the drive means 29, the door means 25 is in its closed condition as will be apparent hereinafter. However, the latch member 27 is moved from its non-latching position directly to a third position thereof as illustrated in FIG. 11 by the drive means 29 when the drive means 29 tends to move the latch member 27 to the latching position thereof when the door means 25 is not in a closed condition thereof as will be apparent hereinafter.

Figure 8:
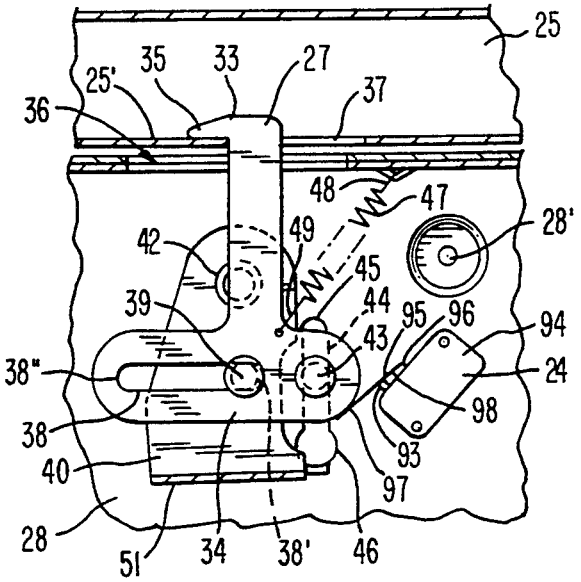
FIG. 8 is a view similar to FIG. 6 and illustrates the latch member in its door latching position of FIG. 7.

The latch member 27 and the electrical switch means 24 are so disposed on the frame means 28 of the cooking apparatus 20 that the switch means 24 is only actuated by the latch member 27 when the latch member 27 is moved to its latching position as illustrated in FIG. 8 and is not actuated when the latch member 27 is moved to its third position as illustrated in FIG. 12 as will also be apparent hereinafter, the switch means 24 not being shown in FIGS. 2, 3, 5, 7, 9, 10 and 11 to facilitate the showing of the structure that is illustrated in such figures.

Thus, it can be seen that the general operation of the latching construction 26 previously described is fully set forth in the aforementioned U.S. patent to Genbauffe et al, U.S. Pat. No. 4,927,996 whereby this U.S. patent is being incorporated into this disclosure by this reference thereto.

Such general operation of the latching construction 26 is also fully set forth in the aforementioned copending patent application, Ser. No. 229,378, filed Apr. 18, 1994.

The frame means 28 of the latching construction 26 comprises a plate 30 formed of any suitable material, such as metallic material, and having a pair of turned ends 31 and 32 that are respectively provided with integral tangs 31' and 32' for a purpose hereinafter set forth.

The latch member 27 comprises a one-piece member formed of any suitable material, such as metallic material, and having opposed ends 33 and 34, the end 33 having a hook 35 and being adapted to project out of an opening means 36 cooperatively formed through the frame means 28, 21 so as to be received through an opening means 37 formed in the side of the door means 25 as illustrated in FIG. 2 when the door means 25 is in its closed condition thereof and the latch member 27 is in the non-latching position thereof.

The end 34 of the latch member has an elongated slot means 38 passing therethrough and receiving a pivot pin means 39 therein, the pivot pin means 39 extending from and being fixed to a leg 40 of a unique drive cam 41 that comprises a unique additional means of the drive means 29 as will be apparent hereinafter. The leg 40 of the drive cam 41 is pivotally mounted to the plate 30 by a pivot pin 42 while the end 34 of the latch member 27 is pivotally mounted to the plate 30 by a pivot pin 43 carried by the latch member 27 and extending into an elongated slot means 44 formed through the plate 30 and having opposed ends 45 and 46, the pivot pin 43 being rotatable and slidable in the slot 44 for a purpose hereinafter described.

Figure 4:
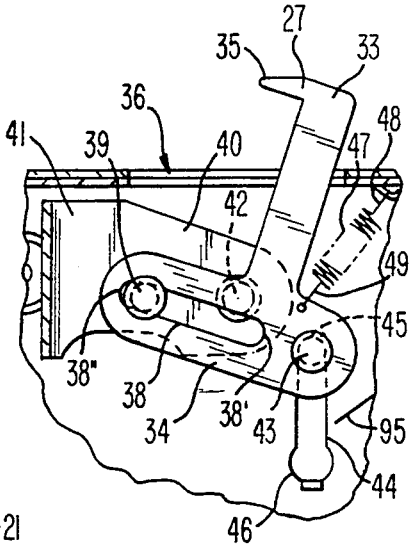
FIG. 4 is a fragmentary cross-sectional view taken on line 4—4 of FIG. 3 and illustrating part of the latching construction in its non-latching position.

A torsion spring 47 has one end 48 hooked to the tang 31' of the plate 30 and the other end 49 fastened to the latch member 27 in such a position that the force of the torsion spring 47 normally tends to maintain the latch member 27 in the non-latching position illustrated in FIG. 4 where the pivot pin 43 is at the end 45 of the slot 44.

The drive cam 41 has another leg 50 disposed in spaced parallel relation to the leg 40 and being interconnected thereto by a cross member 51, the drive cam 41 being formed of any suitable material, such as metallic material. The leg 50 of the drive cam 42 has an elongated slot 52 formed therethrough and provided with opposed ends 53 and 54, the opposed ends 53 and 54 respectively having increased areas 53' and 54' over the width of the slot 52 to respectively receive an adapter drive pin 55 therein in a manner hereinafter described.

The drive means 29 comprises a piston and cylinder unit 56 which comprises a tubular cylinder member 57 and a piston means 58, the piston means 58 comprising a piston rod 59 interconnected to a piston 60 disposed in the cylinder member 57 and normally being urged to a position wherein the piston means 58 is in its fully retracted condition by an internal compression spring means 61 also disposed in the cylinder member 57.

The piston and cylinder means 56 includes an actuator 62 disposed in the cylinder member 57 and when interconnected to an electrical power source 63, the actuator 62 is actuated and causes the piston means 58 to move to an extended condition relative to the cylinder member 57 in opposition to the force of the compression spring means 61 for a purpose hereinafter set forth, the actuating means 62 comprising an electrical heater means which causes an expansion of a fluid means (not shown) disposed in the cylinder member 57 when the heater means 62 is energized by the source 63 to drive the piston 60 upwardly in FIG. 1 to extend the piston rod 59 from the retracted condition illustrated in FIG. 2 to the extended condition illustrated in FIG. 7 for a purpose hereinafter described. However, when the electrical power source is disconnected from the actuator means 62, the actuator means 62 is deactuated and the spring means 61 is adapted to return the piston means 58 to its retracted condition as illustrated in FIG. 2 as will be apparent hereinafter.

Since the operation and structure of the piston and cylinder unit 56 is well known in the art, the spring means 61, the actuator means 62, the piston 60 and the piston rod 59 have been schematically illustrated in the drawings and need not be further described. For example, see the piston and cylinder units known as electrothermal means set forth in the aforementioned U.S. patent to Huebscher, U.S. Pat. No. 3,805,528; the U.S. patent to Stropkay, U.S. Pat. No. 4,095,427 and the U.S. patent to Birli, Sr. et al, U.S. Pat. No. 4,887,429 whereby these three U.S. patents are being incorporated into this disclosure by this reference thereto.

The piston rod 59 of the piston means 58 has an outer section 64 of a certain diameter extending out of one end 65 of the cylinder member 57, the piston rod 59 having a smaller sized end 66 extending from the piston rod section 64 and passing through a suitable opening (not shown) formed through a flange 67 of an actuator adapter 68 so that the flange 67 rests against the piston rod section 64 and will move therewith as will be apparent hereinafter, the actuator adapter 68 having a section 69 disposed at a right angle to the flange 67 and having opposed ends 70 and 71 extending outwardly from the piston end 66 while a medial portion 72 of the section 69 is bent so as to be disposed around the piston rod end 66 and carries the adapter pin 55 which rides in the slot 52 of the drive cam 42 to operate the drive cam 42 as the piston means 58 is extended and retracted as will be apparent hereinafter.

A mounting bracket 73 formed of any suitable material, such as metallic material, is utilized to mount the actuator unit 56 to the plate 30, the bracket 73 being pivotally mounted to the plate 30 by a pivot pin 74 that has a center 75.

The mounting bracket 73 has a flange 76 extending substantially at a right angle to a cross member 77 thereof that is pivotally mounted to the plate 30 by the pivot pin 74, the flange 76 having an opening 78 passing therethrough and through which a first section 79 of the cylinder member 57 extends while an outwardly directed annular abutment means 80 of the cylinder member 57 abuts against a side 81 of the flange 76 as illustrated in FIG. 3 so as to maintain another section 82 of the cylinder member 57 beyond the side 81 of the flange 76.

Another flange 83 of the mounting bracket 73 extends from the cross member 77 thereof in spaced parallel relation to the flange 76 and faces a side 84 thereof, the flange 83 being bifurcated to define two parts 85 straddling the section 79 of the cylinder member 57 adjacent the other end 65' thereof as illustrated.

A pair of like tension springs 86 and 87 respectively have first ends 88 hooked or fastened to the respective ends 70 and 71 of the actuator adapter 68 and the other ends 89 thereof respectively interconnected to the bifurcated parts 85 of the mounting bracket 73 so that the force of the tension springs 86 and 87 not only tend to maintain the actuator adapter 68 on the piston means 58 so that the flange 67 thereof abuts the enlarged section 64 thereof but also tend to retard the extension of the piston means 58 if the piston and cylinder means 56 senses higher ambient temperatures.

An over center tension spring 90 has one end 91 interconnected to an upstanding end 92 of the flange 76 of the mounting bracket 73 and has the other end 92 thereof hooked to the tang 32' of the plate 30 so that the force of the over center tension spring 90 controls the pivoting movement of the mounting bracket 73 relative to the plate 30 and, thus, the effective direction of force of the extending piston means 58 as will be apparent hereinafter.

As illustrated in FIG. 8, the electrical switch 24 has an actuator button 93 extending from a housing means 94 thereof and is normally urged outwardly by internal spring means (not shown) so that as long as the actuator button 93 is in an out condition, the switch means 24 will not permit the heating means 23 of the cooking apparatus 20 to be operated to heat clean the chamber 22. However, when the actuator button 93 is moved inwardly relative to the housing 94, the switch means 24 permits the heating means 23 to be actuated to heat clean the chamber means 22 as long as the actuator button 93 is in its actuated condition.

In particular, a switch arm 95 has one end 96 thereof pivotally mounted to the housing means 94 of the switch means 24 while the other end 97 of the arm 95 extends beyond the actuator button 93 which bears against a medial portion 98 of the arm 95 whereby the force of the internal spring means acting on the actuator button 93 is adapted to maintain the button 93 outwardly even though the arm 95 is contacting the button 93. However, the end 34 of the latch member 27 is adapted to engage against the end 97 of the arm 95 and move the actuator button 93 to the actuating position thereof when the latch member 27 is in the latching position as illustrated in FIG. 8 but will not engage against the end 97 of the arm 95 when the latch member 27 is in the position illustrated in FIG. 4, FIG. 6 or FIG. 12 so that it is only when the latch member 27 is in the fully latching position thereof as illustrated in FIG. 8 that the switch means 24 will be operated to permit the heating means 23 to heat clean the oven 22 as will be apparent hereinafter.

Therefore, it can be seen that it is a relatively simple method of this invention to make the latching construction 26 of this invention to operate in the cooking apparatus 20 in a manner now to be described.

Normally the latch construction 26 is disposed in the condition illustrated in FIGS. 1 and 2 where the latch member 27 is in its non-latching position with the piston means 58 being in its fully retracted condition so that the actuator drive pin 55 is disposed at the end 54 of the slot 52 in the drive cam 42 and the over center tension spring 90 is tending to pivot the mounting bracket 73 and, thus, the piston and cylinder means 56 in a clockwise direction about the pivot pin 74 when viewing FIG. 2.

Figure 5:
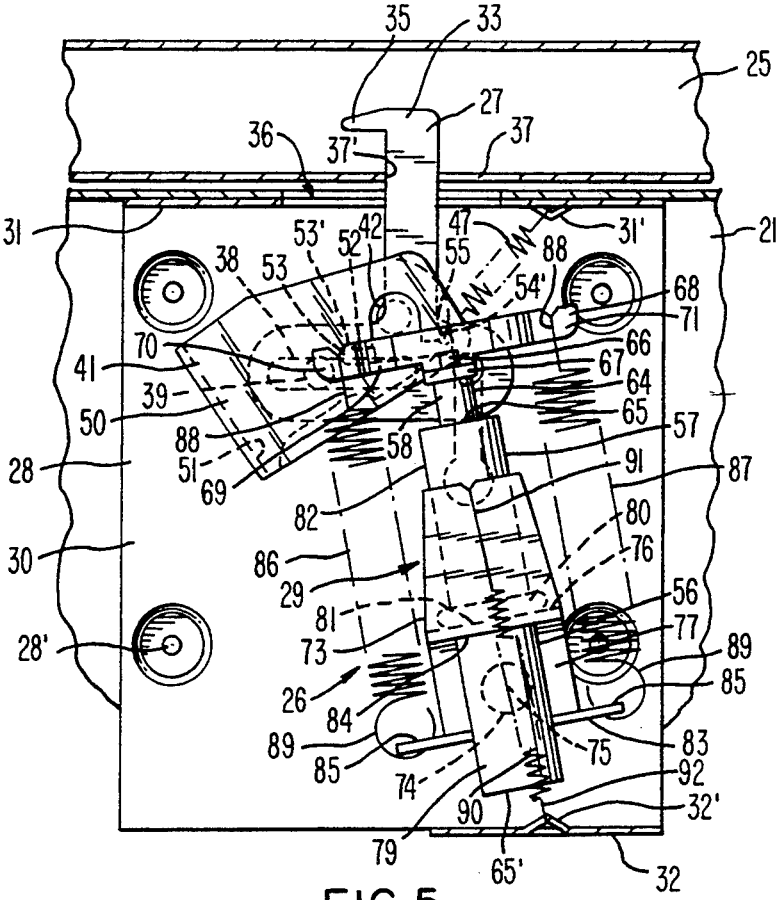
FIG. 5 is a view similar to FIG. 2 and illustrates the latch member having been moved to a position thereof wherein the same initially makes contact with the closed oven door of the cooking apparatus.
Figure 6:
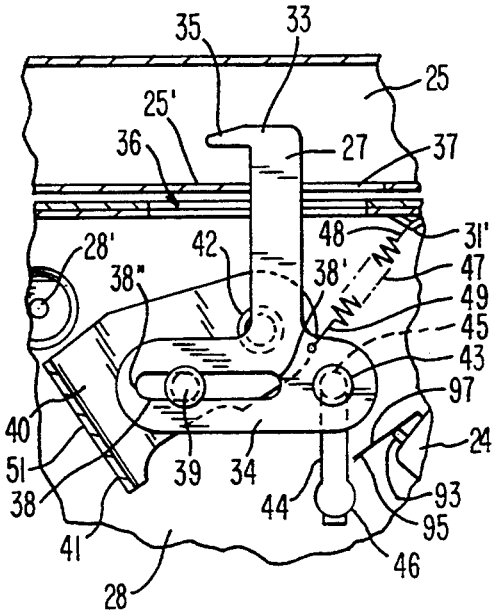
FIG. 6 is a fragmentary view similar to FIG. 4 and illustrating the latch member when in the initial door engaging position of FIG. 5.

When it is desired to latch the oven door 25 in its closed condition as illustrated in FIG. 2, the operator through a suitable switch (not shown) causes the electrical power source 63 to be interconnected to the actuator means 62 of the drive means 29 to cause the piston means 58 to be extended outwardly from the cylinder member 57 in opposition to the force of the springs 61, 86 and 87 as illustrated in FIG. 5, such outward movement of the piston means 58 causing the drive cam 41 to pivot in a counterclockwise direction as illustrated in FIG. 5 as the adaptor pin 55 has now moved into the increased area 54' of the slot 52 and pushes on the drive cam 41. Such counterclockwise rotation of the drive cam 41 causes the pivot pin 39 carried by the leg 40 thereof to move in the slot 38 of the latch member 27 and cause the latch member 27 to pivot in a counterclockwise direction about the center of the pivot pin 43 as illustrated in FIGS. 5 and 6 until the latch member 27 engages against an edge 37' of the oven door 25 defined by the opening 37 thereof so that the latch member 27 can no longer be moved in a counterclockwise direction by the outwardly extending piston means 58. However, further movement of the piston means 58 in an extended direction thereof continues to cause the drive cam 41 to pivot in a counterclockwise direction as illustrated in FIG. 6 to the position illustrated in FIG. 8 whereby the movement of the pivot pin 39 toward an end 38' of the slot 38 causes the pivot pin 43 carried by the latch member 27 to slide downwardly in the slot 44 of the plate 30 as illustrated in FIG. 8 until the hook 35 of the latch member 27 engages against the side 25' of the oven door 25, pulls the oven door 25 tightly closed and holds the same in its closed condition as illustrated in FIGS. 7 and 8. Such movement of the latch member 27 to its locking condition as illustrated in FIGS. 7 and 8 causes the end 34 of the latch member 27 to operate on the end 97 of the arm 95 of the switch 24 to move the actuator button 93 to its actuated condition whereby the switch means 24 now permits the heating means 23 of the cooking apparatus 20 to heat clean the oven 22.

However, after the piston means 58 of the drive means 29 has moved to its extended condition as illustrated in FIG. 7 so as to move the latch member 27 to its locking condition as previously set forth, the operator or the control means for the cooking apparatus 20 terminates the flow of electrical current to the actuator means 62 of the drive means 29 so that the internal spring means 61 of the drive means 29 will now move the piston means 58 from its fully extended position back to its fully retracted position and such movement of the piston means 58 causes the adaptor pin 55 to now move down the slot 52 of the drive cam 41 from the end 54 thereof to the end 53 thereof as illustrated in FIG. 9 and the over center tension spring 90 causes the mounting bracket 73 to pivot on the pivot pin 74 so that the tension spring 90 is now slightly to the left of the center 75 of the pivot pin 74 so that a subsequent outward movement of the piston means 58 will tend to be to the left when viewing FIG. 9 rather than to the right as was the case when viewing FIG. 2.

Thus, the drive cam 41 is held in the slightly over center pivoted position of FIG. 9 by the force of the spring means 61 and maintains the latch member 27 in its locking position even though the drive means 29 is now in its deactuated condition and the piston means 58 is in its retracted condition. If desired, the drive cam 41 when rotating slightly over center, can come to rest against a stop tab (not shown) on the plate 30.

In this manner, the actuator 62 of the drive means 29 need not be maintained in an actuated condition thereof during the entire time that the oven chamber 22 is being heat cleaned by the heating means 23.

Figure 10:
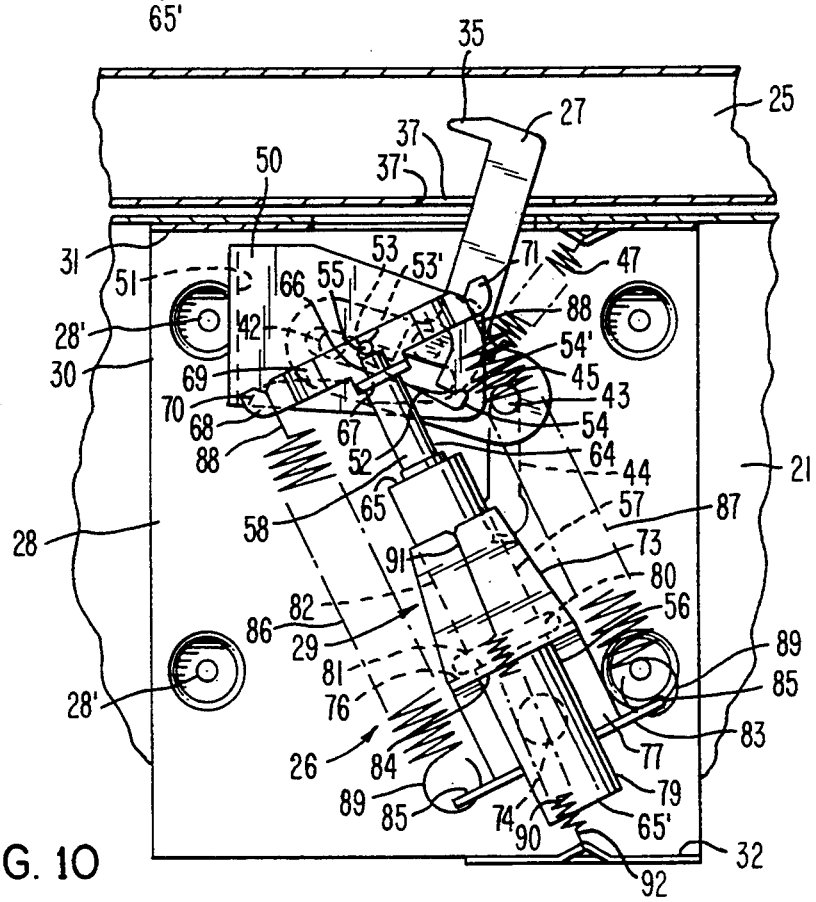
FIG. 10 is a view similar to FIG. 9 and illustrates the latch member having been moved from its door locking position of FIG. 9 to its unlatching position of FIG. 2 by the drive means being again actuated to extend its piston means so as to so move the latch member from its latching position to its non-latching position.

After the oven chamber 22 has been heat cleaned and the heating means 23 has been turned off by the control means (not shown) of the cooking apparatus 20 so that the temperature of the oven chamber 22 eventurally falls below a safe temperature, such as below approximately 600° F., the operator or the control means of the cooking apparatus 20 causes the power source 63 to be interconnected to the actuator 62 to again cause the piston means 58 to be outwardly extended from its retracted condition as illustrated in FIG. 9 but now the extending piston means 58 causes the actuator pin 55 to be received in the further opening 53' of the slot 52 in the drive cam 41 to now rotate the drive cam 41 in a clockwise direction about its pivot pin 42 and thereby move the pivot pin 39 in the slot 38 of the latch member 27 toward the end 38" thereof and thereby cause the latch member 27 to pivot in a clockwise direction and have the pivot pin 43 carried thereby slide upwardly in the slot 44 toward the end 45 thereof as illustrated in FIG. 10 to now unlock the door 25. The tension spring 47 now holds the latch member 27 in its non-latching position. Once the door 25 has been unlocked, the flow of electrical current from the source 23 to the actuator 62 of the drive means 29 is terminated so that the internal spring means 61 of the drive means 29 now causes the piston means 58 to be retracted and in this position of the drive means 29, it can be seen that the mounting bracket 73 has pivoted on the pivot pin 74 so that the tendency of the adaptor pin 55 moving down the slot 52 from the end 53' thereof toward the end 54' thereof causes the tension spring 90 to be over center and bias the actuator slightly to the right when the adaptor pin 55 reaches the end 54' of the slot 52 as illustrated in FIG. 2 so that the adaptor pin 55 will be in a proper position to thereafter move upwardly into the end portion 54' of the slot 52 to perform a latching operation in the manner previously described when needed.

However, should the oven door 25 not be in a closed condition when the drive means 29 is actuated to begin a door locking operation, such outward movement of the piston means 58 causes the drive cam 41 to pivot in a counterclockwise direction and cause the latch member 27 to also pivot in a counterclockwise direction but since the latch member 27 does not hit the edge 37' of the oven door 25, the latch member 27 continues to pivot in the manner illustrated in FIG. 11 and not have the pivot pin 43 thereof leave the upper end 45 of the slot 44 so that when the piston means 58 is fully extended as illustrated in FIG. 11, it can be seen in FIG. 12 that such condition of the latch member 27 will not cause the end 34 thereof to engage the arm 95 of the switch means 24 to actuate the actuator button 93 thereof. Thus, once the actuator means 62 is disconnected from the power source 63, the internal spring means 61 of the drive means 29 will now retract the piston means 58 from the position illustrated in FIG. 11 so that the actuator pin 55 now moves down the slot 52 of the drive cam 41 so as to be positioned at the end 53 thereof. In this manner, a subsequent actuation of the actuator 62 to extend the piston means 58 will cause the drive cam 41 to rotate in a clockwise direction and thereby permit the latch member 27 to likewise pivot in a clockwise direction and return to its non-latching position as illustrated in FIG. 2.

Therefore, it can be seen that this invention not only provides a new cooking apparatus and a new method of making such a cooking apparatus, but also this invention provides a new latching construction for a cooking apparatus and a new method of making such a new latching construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a cooking apparatus comprising a frame means, a cooking chamber means carried by said frame means, heating means carried by said frame means and being adapted to be actuated to heat clean said chamber means, switch means for permitting said heating means to heat clean said chamber means only when said switch means is actuated, a movable door means carried by said frame means for opening and closing said cooking chamber means, a movable latch member carried by said frame means and being movable between a non-latching position thereof that permits said door means to be opened and closed and a latching position thereof that locks said door means in its closed position and actuates said switch means if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, said drive means comprising a cylinder means having opposite ends and a movable piston means extending from one of said opposite ends and comprising said moving means operatively interconnected to said latch member, said drive means having actuating means to extend said piston means so as to be adapted to move said latch member from its said non-latching position thereof to its said latching position thereof when said actuating means is first actuated for a door locking operation thereof, the improvement wherein said drive means has additional means adapted to cause said piston means to be retracted after said latch member has been moved to said latching position thereof by said first activation of said actuating means while maintaining said latch member in its said latching position until said actuating means is again actuated.

2. A cooking apparatus as set forth in claim 1 wherein said additional means of said drive means is adapted to cause said latch member to move from said latching position thereof to said non-latching position thereof by extending said piston means when said actuating means is said again actuated.

3. A cooking apparatus as set forth in claim 2 wherein said actuating means of said drive means comprises an electro-thermal means.

4. A cooking apparatus as set forth in claim 1 wherein said actuating means of said drive means is electrically operated.

5. A cooking apparatus as set forth in claim 1 wherein said latch member is movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof, said latch member being adapted to actuate said switch means only when said latch member is in said latching position thereof.

6. In a latching construction for a cooking apparatus having a cooking chamber means and a movable door means for opening and closing said cooking chamber means, said latch construction comprising a frame means, a movable latch member carried by said frame means and being movable between a non-latching position thereof that would permit said door means to be opened and closed and a latching position thereof that would lock said door means in its closed position if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, said drive means comprising a cylinder means having opposite ends and a movable piston means extending from one of said opposite ends and comprising said moving means operatively interconnected to said latch member, said drive means having actuating means to extend said piston means so as to be adapted to move said latch member from its said non-latching position thereof to its said latching position thereof when said actuating means is first actuated for a door locking operation thereof, the improvement wherein said drive means has additional means adapted to cause said piston means to be retracted after said latch member has been moved to said latching position thereof by said first actuation of said actuating means while maintaining said latch member in its said latching position until said actuating means is again actuated.

7. A latching construction as set forth in claim 6 wherein said additional means of said drive means is adapted to cause said latch member to move from said latching position thereof to said non-latching position thereof by extending said piston means when said actuating means is said again actuated.

8. A latching construction as set forth in claim 6 wherein said actuating means of said drive means is electrically operated.

9. A latching construction as set forth in claim 8 wherein said actuating means of said drive means comprises an electro-thermal means.

10. A latching construction as set forth in claim 6 wherein said latch member is movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof.

11. In a method of making a cooking apparatus comprising a frame means, a cooking chamber means carried by said frame means, heating means carried by said frame means and being adapted to be actuated to heat clean said chamber means, switch means for permitting said heating means to heat clean said chamber means only when said switch means is actuated, a movable door means carried by said frame means for opening and closing said cooking chamber means, a movable latch member carried by said frame means and being movable between a non-latching position thereof that permits said door means to be opened and closed and a latching position thereof that locks said door means in its closed position and actuates said switch means if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, said drive means comprising a cylinder means having opposite ends and a movable piston means extending from one of said opposite ends and comprising said moving means operatively interconnected to said latch member, said drive means having actuating means to extend said piston means so as to be adapted to move said latch member from its said non-latching position thereof to its said latching position thereof when said actuating means is first actuated for a door locking operation thereof, the improvement comprising the step of forming said drive means to have additional means adapted to cause said piston means to be retracted after said latch member has been moved to said latching position thereof by said first actuation of said actuating means while maintaining said latch member in its said latching position until said actuating means is again actuated.

12. A method of making a cooking apparatus as set forth in claim 11 and comprising the step of forming said additional means of said drive means to be adapted to cause said latch member to move from said latching position thereof to said non-latching position thereof by extending said piston means when said actuating means is said again actuated.

13. A method of making a cooking apparatus as set forth in claim 11 and comprising the step of forming said actuating means of said drive means to be electrically operated.

14. A method of making a cooking apparatus as set forth in claim 13 and comprising the step of forming said actuating means of said drive means to comprise an electro-thermal means.

15. A method of making a cooking apparatus as set forth in claim 11 and comprising the steps of forming said latch member to be movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof, and forming said latch member to be adapted to actuate said switch means only when said latch member is in said latching position thereof.

16. In a method of making a latching construction for a cooking apparatus having a cooking chamber means and a movable door means for opening and closing said cooking chamber means, said latch construction comprising a frame means, a movable latch member carried by said frame means and being movable between a non-latching position thereof that would permit said door means to be opened and closed and a latching position thereof that would lock said door means in its closed position if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, said drive means comprising cylinder means having opposite ends and a movable piston means extending from one of said opposite ends and comprising said moving means operatively interconnected to said latch member, said drive means having actuating means to extend said piston means so as to be adapted to move said latch member from its said non-latching position thereof to its said latching position thereof when said actuating means is first actuated for a door locking operation thereof, the improvement comprising the step of forming said drive means to have additional means adapted to cause said piston means to be retracted after said latch member has been moved to said latching position thereof by said first actuation of said actuating means while maintaining said latch member in its said latching position until said actuating means is again actuated.

17. A method of making a latching construction as set forth in claim 16 and comprising the step of forming said additional means of said drive means to be adapted to cause said latch member to move from said latching position thereof to said non-latching position thereof by extending said piston means when said actuating means is said again actuated.

18. A method of making a latching construction as set forth in claim 16 and comprising the step of forming said actuating means of said drive means to be electrically operated.

19. A method of making a latching construction as set forth in claim 18 and comprising the step of forming said actuating means of said drive means to comprise an electro-thermal means.

20. A method of making a latching construction as set forth in claim 16 and comprising the step of forming said latch member to be movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof.

* * * * *